United States Patent [19]

Violi

[11] Patent Number: 4,823,766

[45] Date of Patent: Apr. 25, 1989

[54] GAS STEAM OVEN

[75] Inventor: Raymond Violi, Faverges, France

[73] Assignee: SC Bourgeois, Faverges, France

[21] Appl. No.: 139,436

[22] Filed: Dec. 30, 1987

[30] Foreign Application Priority Data

Aug. 1, 1987 [FR] France ..... 87 00413

[51] Int. Cl.[4] ..... A21B 1/08

[52] U.S. Cl. ..... 126/20; 126/21 A; 126/369; 99/467; 99/473; 99/476

[58] Field of Search ..... 126/20, 21 A, 369; 431/3, 29, 121; 99/467, 473, 474, 476; 426/510, 511

[56] References Cited

U.S. PATENT DOCUMENTS 2,524,272 10/1950 Sage ..... 126/20 X
4,563,945 1/1986 Hwang ..... 426/510 X
4,648,381 3/1987 Ishii et al. ..... 126/20

FOREIGN PATENT DOCUMENTS 2050159 5/1971 Fed. Rep. of Germany .
2396927 2/1979 France .
2172990 10/1986 United Kingdom .

*Primary Examiner*—Samuel Scott
*Assistant Examiner*—Carl D. Price
*Attorney, Agent, or Firm*—Ratner & Prestia

[57] ABSTRACT

A gas steam oven is provided including the assembly of elements of direct heating and convection gas oven, and further includes a steam generator, an auxiliary heat source maintaining the burner at a temperature greater than the steam condensation temperature in the enclosure; a permanent flow of air in the air-gas mixture intake duct making it possible to re-ignite the burner after a period of combustion interruption.

8 Claims, 2 Drawing Sheets

GAS STEAM OVEN

BACKGROUND OF THE INVENTION

The present invention relates to steam ovens, particularly for the kitchen and collective organizations.

Gas convection and direct heating ovens have been known for some years, including an oven enclosure containing the material to be heated, and at least one gas burner placed inside the enclosure. A turbine for stirring the atmosphere inside the enclosure driven by an electric motor ensures internal convection. A pipe for discharging the burnt gases places the inside of the enclosure in communication with the external atmosphere. An intermediate duct connects the gas burner to external equipment including an air booster and means for producing and feeding into the intermediate duct an appropriate air-gas mixture, the air coming from the air booster and the gas from a gas intake pipe. The fact of disposing the burner inside the oven enclosure provides a very rapid rise of temperature in the oven which, associated with the forced convection provided by the turbine, makes possible very rapid heating of the material contained in the oven.

The preparation of food in such an oven however tends to dry out said food and to form a crust on the surface which disturbs cooking. To avoid this drawback, a second family of ovens has been developed for some years, also including an oven enclosure and a gas burner being disposed outside the enclosure and heating it by conduction through its casing. A steam generator produces steam which penetrates into the oven enclosure through a steam intake pipe. A forced convection turbine stirs the atmosphere contained in the oven enclosure. However, this type of oven, because of the external position of the gas burner does not provide a temperature rise as rapid as in direct heating gas ovens; furthermore, heat energy losses inevitably occur, part of the energy being discharged to the outside atmosphere without serving for heating the enclosure and the material which is contained therein.

SUMMARY OF THE INVENTION

The purpose of the present invention is in particular to avoid the drawbacks of known ovens, by providing a new oven structure which uses simultaneously the direct gas heating technique and the technique of heating with steam contained in the enclosure.

The combination of these two techniques meets with considerable difficulties, because the burner operates intermittently to provide temperature regulation; it has been discovered that, during the periods when the burner is not operating, steam tends to condense on the walls of the burner and the water tends to penetrate into the air-gas mixture intake ducts, with the risk of compromising subsequent relighting of the burner. The present invention overcomes this problem by providing means for reliably relighting the burner and preventing the penetration of water into the air-gas mixture intake duct.

In accordance with another object of the invention, the operation of the burner is ensured with great safety, and the risks of explosion or ignition of the air-gas mixture inside the duct bringing this mixture are more particularly avoided.

In a way known per se, the oven includes a safety device detecting the presence of a flame at the level of the burner and an ignition device producing a spark for igniting the gas burner. These devices include electrodes connected to an electric control and measuring device. Another object of the invention is also to provide reliable operation of the electrodes in a humid atmosphere, avoiding more particularly the formation of appreciable condensation on the electrodes, which condensation would risk compromising relighting of the gas burner and reliability of the monitoring.

To attain these objects as well as others, the oven of the present invention includes the elements of a convection and direct heating gas oven and combines them with:

a steam generator and a duct for bringing the steam produced by the steam generator into the oven enclosure, heating means for maintaining the gas burner permanently at a temperature greater than the steam condensation temperature, thus avoiding the formation of liquid water in or on the gas burner, means for preventing the steam present in the oven enclosure from penetrating into the intermediate duct.

In an advantageous embodiment, the means for preventing the penetration of steam into the intermediate duct are formed by the air booster, fed with electric energy, and producing an airflow in the intermediate duct and in the gas burner during the periods when the gas combustion is interrupted.

The heating means for keeping the gas burner at the desired temperature advantageously include an auxiliary heat source producing heating of the gas burner, for example an electric resistance or a gas pilot burner.

In a first embodiment, the auxiliary heat source heats the air during its passage through the intermediate duct; the air thus heated and flowing through the intermediate duct and the gas burner heats the gas burner and simultaneously prevents the condensation of steam in the gas burner and on the monitoring and burner ignition electrodes.

In another embodiment, the auxiliary heat source acts directly on the gas burner by conduction, the air flowing through the intermediate duct being heated on passing through the gas burner and drying the electrodes.

BRIEF DESCRIPTION OF THE DRAWINGS

Other objects, features and advantages of the present invention will be clear from the following description of particular embodiments, made with reference to the accompanying figures, in which.

MORE DETAILED DESCRIPTION OF THE INVENTION

Figure 1:
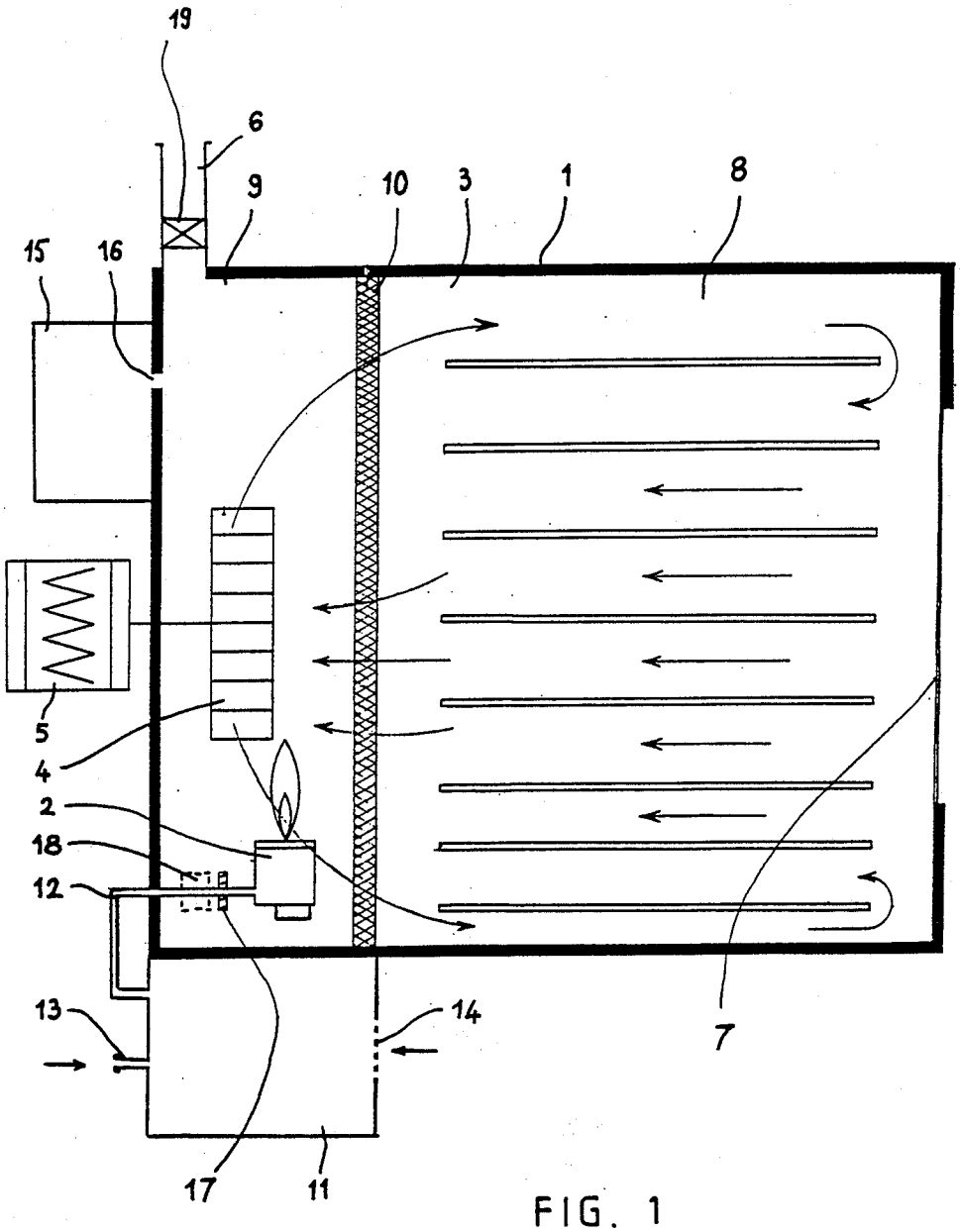
FIG. 1 shows a schematical sectional side view of an oven of the present invention.

As shown in the figures, the oven of the invention includes an oven enclosure 1 for containing the material to be heated, at least one gas burner 2 placed in a rear part 9 of the inside 3 of enclosure 1, and a turbine 4 for stirring the atmosphere inside the enclosure. Turbine 4 is driven by an electric motor 5 fed from the mains. A pipe 6 for discharging the burnt gases is connected to the inside 3 of enclosure 1 at the upper rear part of the enclosure, as shown in the figure. The pipe connects the enclosure 1 of the oven to the outside atmosphere and preferably to outside the premises in which the oven is contained. The front face of enclosure 1 of the oven has an opening which may be closed by a door 7 for placing the material to be introduced into the oven and withdrawn after heating. The material is disposed in a front part 8 of enclosure 1, separated from the rear part 9 by a grid 10, preventing the splashing of grease on gas burner 2 and turbine 4.

Deflectors, not shown in the figures, channel the air and steam flow inside the oven, which flow is produced by turbine 4.

External equipment 11 supplies gas burner 2 with an appropriate air-gas mixture. An intermediate duct 12 connects gas burner 2 and the external equipment 11 together. A gas intake duct 13, connected to an external gas source, brings the gas into the external equipment 11. The air to be mixed with the gas is taken by the external equipment 11 from the ambient atposphere of the premises through an air intake filter 14.

A steam generator 15, for example a steam generator of known type, produces the steam and feeds it into the oven enclosure 1 through a steam intake duct 16. Preferably, duct 16 feeds the steam into enclosure 1 at two points disposed in the upper part of the enclosure and laterally on each side of the middle of the enclosure.

Figure 2:
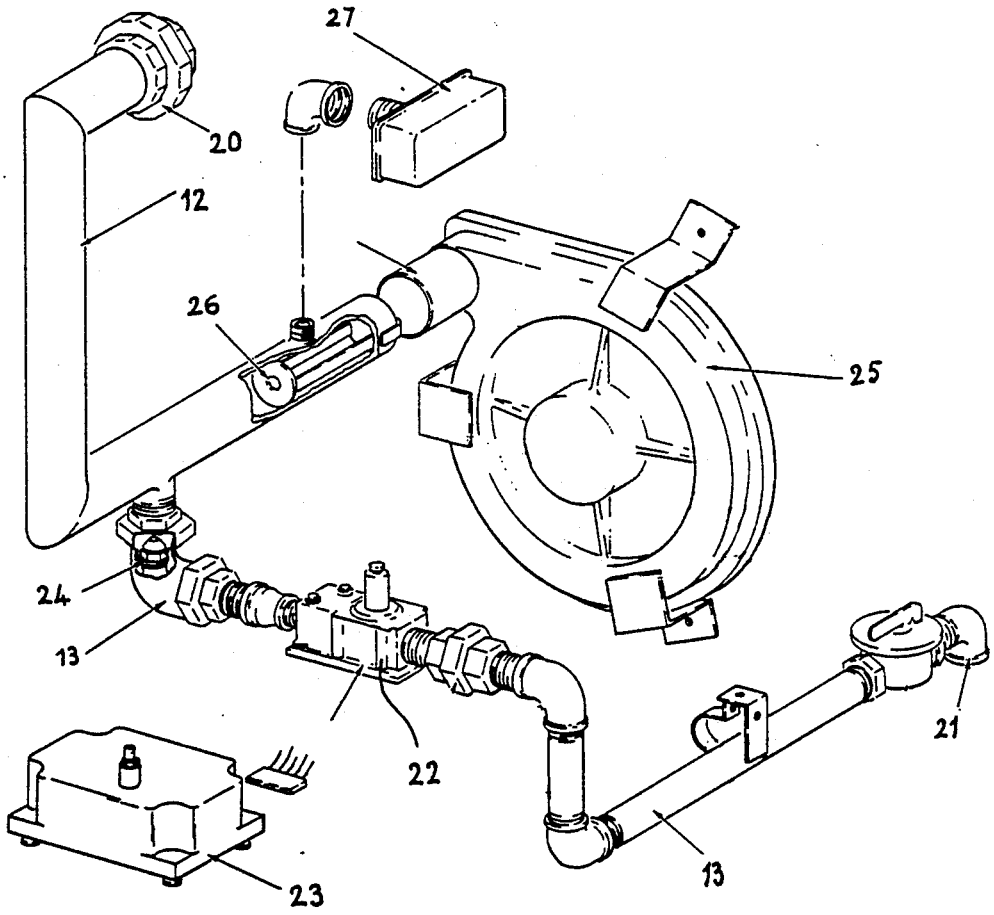
FIG. 2 shows in perspective an exploded view of the external air-gas mixture supply equipment of the invention.

The different members forming the external equipment 11 have been shown in FIG. 2. We find in particular the intermediate duct 12, whose end 20 is intended to be connected to gas burner 2, the gas intake duct 13 whose end 21 is intended to be connected to an external gas intake pipe. The gas intake duct 13 includes two electrovalves 22 controlled by an electric control device 23, for allowing or interrupting the intake of gas. The gas passes through a calibrated injector 24 which introduces it inside the intermediate duct 12 at an appropriate pressure and flowrate for mixing with the air.

The air, taken through the filter 14 from the ambient atmosphere, is slightly compressed by an air booster 25 formed of a turbine actuated by an electric motor fed from the mains, the air leaving the air booster 25 being sent across an adequate diaphragm 26 for mixing thereof in the intermediate duct 12. A pressure sensor 27 detects the presence of compressed air at the output of air booster 25 and is connected to the control device 23.

For constructing the oven of the invention, it is possible to use the assembly of known parts of a convection and direct heating gas oven, in association with a steam generator 15 and a steam intake duct 16. In accordance with the invention, means are further provided for maintaining gas burner 2 permanently at a temperature greater than the steam condensation temperature in enclosure 1. For that, in a first embodiment, an auxiliary heat source 17 is disposed against gas burner 2, as shown in FIG. 1, for example an electric resistance fed from an external electric power source, controlled by the control device 23, or for example a gas pilot burner permanently fed by an auxiliary gas pipe. In these embodiments, an airflow is further provided through the intermediate duct 12 by operating the air booster 25 during the periods when gas burner 2 is extinguished. During these combustion interruption periods, the gas flow is interrupted by the electrovalves 22, whereas air continues to flow in the intermediate duct 12 through the action of the air booster 25.

Alternately, the auxiliary heat source 17 may be disposed in an intermediate position in the intermediate duct 12 so as to heat the air flowing through the intermediate duct 12 during the combustion interruption periods in burner 2.

In another embodiment, a cut-off valve 18 is provided, inserted in the intermediate duct 12 in the vicinity of gas burner 2. The zone of intermediate duct 12 between valve 18 and gas burner 2 is subjected to the action of the auxiliary heat source 17 maintaining the assembly at a temperature greater than the steam condensation temperature in the enclosure. Valve 18 is controlled by the control device 23 causing opening thereof during operation of gas burner 2, and closure thereof during the shut-down of combustion in burner 2. In this embodiment, it is not necessary to maintain an airflow permanently in the intermediate duct.

The oven of the invention is provided for operating in three successive operating modes, as the operator may choose: a convection mode, a steam mode, and a convection and steam mode.

In the convection operating mode, the oven operates in the same way as a convection and direct heating gas oven: motor 5 drives turbine 4 for stirring the atmosphere inside the oven enclosure; the burner 2 causes combustion of an air-gas mixture produced by the external equipment 11; pipe 6 discharges the burnt gases. The steam generator 15 is stopped. Temperature regulation inside the oven enclosure is provided by the control device 23 which receives temperature information from a temperature sensor not shown in the figures, causes the electrovalves 22 to open or to close so as to provide alternate periods of combustion and stopping of combustion in burner 2, and controls the operation of an electrode for igniting the gas at the level of burner 2, which electrode is identical to those in usual direct heating gas ovens.

In the steam operating mode, the electrovalves 22 interrupt the gas feed whereas booster 25 provides an airflow through the intermediate duct 12. The auxiliary heat source 17 maintains burner 2 at a temperature greater than the steam condensation temperature in the enclosure. The steam generator 15 produces steam and feeds it into the oven enclosure 1 through duct 16.

In the convection and steam operating mode, all the parts of the oven are in operation: motor 5 rotates turbine 4 so as to stir the atmosphere inside the enclosure; control device 23 controls the electrovalves 22 and the ignition electrode so as to provide intermittent periods of combustion of the gas in burner 2 so as to maintain the oven at the desired temperature; the steam generator 15 introduces steam into the oven enclosure.

With the means of the invention, it is possible to interrupt combustion of gases in burner 2 and to resume combustion at any moment, despite the presence of steam in the oven.

In the steam position, it is preferable to prevent steam from leaving the oven enclosure. For that, a cutoff valve 19 is inserted in the burnt gas discharge pipe 6, which valve is actuated by drive means controlled by the control means 23 closing it during steam operation and opening it during operation of burner 2.

The present invention is not limited to the embodiments which have been more explicitly described, but includes the different variants and generalizatons thereof contained in the scope of the following claims.

What is claimed is:

1. A direct heating and convection gas oven, including an oven enclosure intended to contain the material to be heated, at least one gas burner placed inside the enclosure, a turbine stirring the atmosphere inside the enclosure, a burnt gas discharge pipe, an intermediate duct connecting the burner to external equipment including an air booster and means for producing and feeding into the intermediate duct an appropriate mixture of air leaving the booster and gas coming from a gas intake duct, further comprising:

a steam generator and a duct for bringing the steam produced by the steam generator into the oven enclosure, heating means for maintaining the gas burner permanently at a temperature greater than the steam condensation temperature, thus avoiding the formation of liquid water in or on the gas burner, means for preventing the steam present in the oven enclosure from penetrating into the intermediate duct.

2. The oven as claimed in claim 1, wherein said means for preventing the pentration of steam into the intermediate duct are formed by the air booster, fed with electric energy and producing an airflow in the intermediate duct and in the burner during the gas combustion interruption periods.

3. The oven as claimed in claim 1, wherein said heating means for maintaining the burner at the desired temperature include an auxiliary heat source producing heating of the burner.

4. The oven as claimed in claim 3, wherein said auxiliary heat source is an electric resistance, fed from an external electric power source.

5. The oven as claimed in claim 3, wherein said auxiliary heat source is a gas pilot burner permanently fed with gas.

6. The oven as claimed in claim 4, wherein said auxiliary heat source heats the air during passage thereof through the intermediate duct, the air thus heated and flowing through the intermediate duct and the burner preventing the condensation of steam in the burner and the intermediate duct.

7. The oven as claimed in claim 4, wherein said auxiliary heat source acts directly on the burner.

8. The oven as claimed in claim 1, wherein the means for preventing the penetration of steam into the intermediate duct include a cut—off valve inserted in the intermediate duct in the vicinity of the burner, the zone of the intermediate duct between the valve and the burner being subjected to the action of an auxiliary heat source maintaining its temperature at a value greater than the steam condensation temperature in the enclosure, the valve being controlled by control means causing opening thereof during operation of the burner and closure thereof during stopping of combustion in the burner.

* * * * *